United States Patent [19]

Wilson

[11] 4,124,966

[45] Nov. 14, 1978

[54] AUTOMATIC WICKETTED BAG LOADER

[75] Inventor: Lowell A. Wilson, Burlington, Canada

[73] Assignee: Bonar & Bemis, Ltd., Burlington, Canada

[21] Appl. No.: 756,203

[22] Filed: Jan. 3, 1977

[30] Foreign Application Priority Data

Dec. 9, 1976 [CA] Canada ..... 267496

[51] Int. Cl.[2] ..... B65B 1/00; B65B 3/00; B65B 5/00; B65B 43/34

[52] U.S. Cl. ..... 53/452; 53/469; 53/572; 53/266 R; 53/371; 53/373; 53/385

[58] Field of Search ..... 53/29, 37, 187–190, 53/266, 268, 371, 373, 384–386

[56] References Cited

U.S. PATENT DOCUMENTS

| | | | |
|---|---|---|---|
| 3,407,567 | 10/1968 | Hudson | 53/190 X |
| 3,673,759 | 7/1972 | Ayres et al. | 53/190 X |
| 3,896,605 | 7/1975 | Chevalier | 53/266 |
| 3,897,676 | 8/1975 | Membrino | 53/189 |
| 3,949,536 | 4/1976 | Chevalier | 53/384 X |

*Primary Examiner*—Robert Louis Spruill
*Attorney, Agent, or Firm*—H. Wayne Rock

[57] ABSTRACT

An automatic wicketted bag loader is suited to load one bag while simultaneously closing and sealing a preceding bag, each bag to contain a predetermined amount of a commodity. A hopper feeds the commodity when desired into a wicket bag which has been opened via mechanism connected to a retractable hopper-closing plate. A bag clamping mechanism simultaneously moves into position adjacent the sides of the opened bag and clamps the sides at about the midpoint thereof such that when the plate returns to its hopper-closing position the bag sides are drawn apart at the opening to bring the bag faces close together. The bag opening changes its configuration from generally square to a long rectangle. Clamping mechanism then moves laterally to encompass the bag opening and to clamp the two faces together and to then withdraw the clamped bag from below the hopper. The clamped bag may be heat sealed as it is withdrawn and then fed to an output conveyor. During withdrawal another bag may be loaded.

19 Claims, 7 Drawing Figures

AUTOMATIC WICKETTED BAG LOADER

The present invention relates in general to the closing of bags and, in particular, to a method and apparatus for clamping a flexible poly-bag and preparing it for closure.

BACKGROUND OF THE INVENTION

Recently, in the dairy industry and in other industries dealing in consumer goods such as food products, there has been a growing trend to the use of thin-walled poly-bags for packaging purposes. Milk may be found in pouches and the pouches may be found in overbags. Potato chips, cereals, fertilizers, kitty litter, pet food and laundry detergents, are examples of other products found in poly-bags which are usually hermetically sealed as by heat sealing to preserve freshness. Vegetables and bakery products are often packaged in poly-bags which may be closed by pressure-sensitive adhesive tapes or reusable fastening devices. All of these products share the common steps of loading a predetermined weight, number or volume of a commodity into a bag and subsequently closing the bag hermetically or otherwise. The speed with which the filling and closing operations can be accomplished is governed by a number of factors, not the least of which is the capacity of the filling and closing apparatus itself. Other constraints are found in the feeding, weighing (or counting) and removal stages.

Many filling machines in the past have utilized gravity feed for the commodity to be packaged, the commodity passing downwardly through a hopper into a bag positioned therebeneath. Once the bag was properly filled it was removed from the filling location and passed, as by a conveyor to a closure station. In many instances, the hopper could double as a counting or weighing device to determine the exact amount of the commodity to be allowed to fall into the bag.

If the bag was to be hermetically sealed, or even if the opening was to be brought together to form a "pony tail, " the machine designer was faced with the random location of the bag sides after the bag had fallen from the hopper. If the bag was to be sealed it was necessary to bring the bag sides together face to face for a bar sealer. If the bag sides were to be gathered for a "pony tail" configuration it was necessary to somehow encircle the bag sides and bring them together into the "pony tail" for application of the appropriate fastener or closure member. Needless to say the equipment for this step preliminary to actual closure was, of necessity, sophisticated and expensive.

SUMMARY OF THE INVENTION

The present invention seeks to overcome the problems of the prior art by providing a filling and closing device wherein the bag opening is controlled at all times and hence the equipment required to grasp and close the bag becomes simple, effective and less expensive than prior art equipment. The present invention achieves this objective by grasping the end edges of an opened bag adjacent the opening and, once the bag has been filled, drawing those ends outwardly until the opposing faces come into close juxtaposition this without releasing the bag from its position below the filling hopper. Once the bag is in this closed position it is clamped and removed laterally from below the hopper. If the bag is to be hermetically sealed a heat sealer within the clamping means will effect the heat seal during the lateral transfer. If the bag is to be formed into a "pony tail" a suitable ram may be used to bunch the sides together.

The present invention may, therefore, be described briefly as an apparatus for loading a bag with a commodity via a hopper having a retractable bottom closure member comprising; means for arranging at least one empty bag adjacent the hopper, the bag having an open end adjacent the closure member; means for opening the bag and essentially simultaneously retracting the closure member from below the hopper to permit the commodity to pass into the opened bag, the member serving to hold the bag open; means for gripping opposed end portions of the opened bag; means for moving the gripping means apart thereby bringing opposed faces of the bag into close juxtaposition; and means for clamping the opposed faces together and removing the clamped bag from below the hopper.

The present invention is also found in a packaging method described as a method for loading a bag with a commodity from a hopper provided with a movable bottom closure member comprising the steps of; essentially simultaneously opening the hopper by retracting the closure member, opening a bag below the hopper and gripping opposed end edges of the bag at the opening thereof; drawing the opening to an essentially closed condition by moving the opposed end edges away from each other thereby creating a pair of opposed and closely adjacent bag faces; and clamping the faces together over the length thereof to hold the bag firmly and laterally withdrawing the clamped bag from below said hopper.

DESCRIPTION OF THE PREFERRED EMBODIMENT

Figure 1:
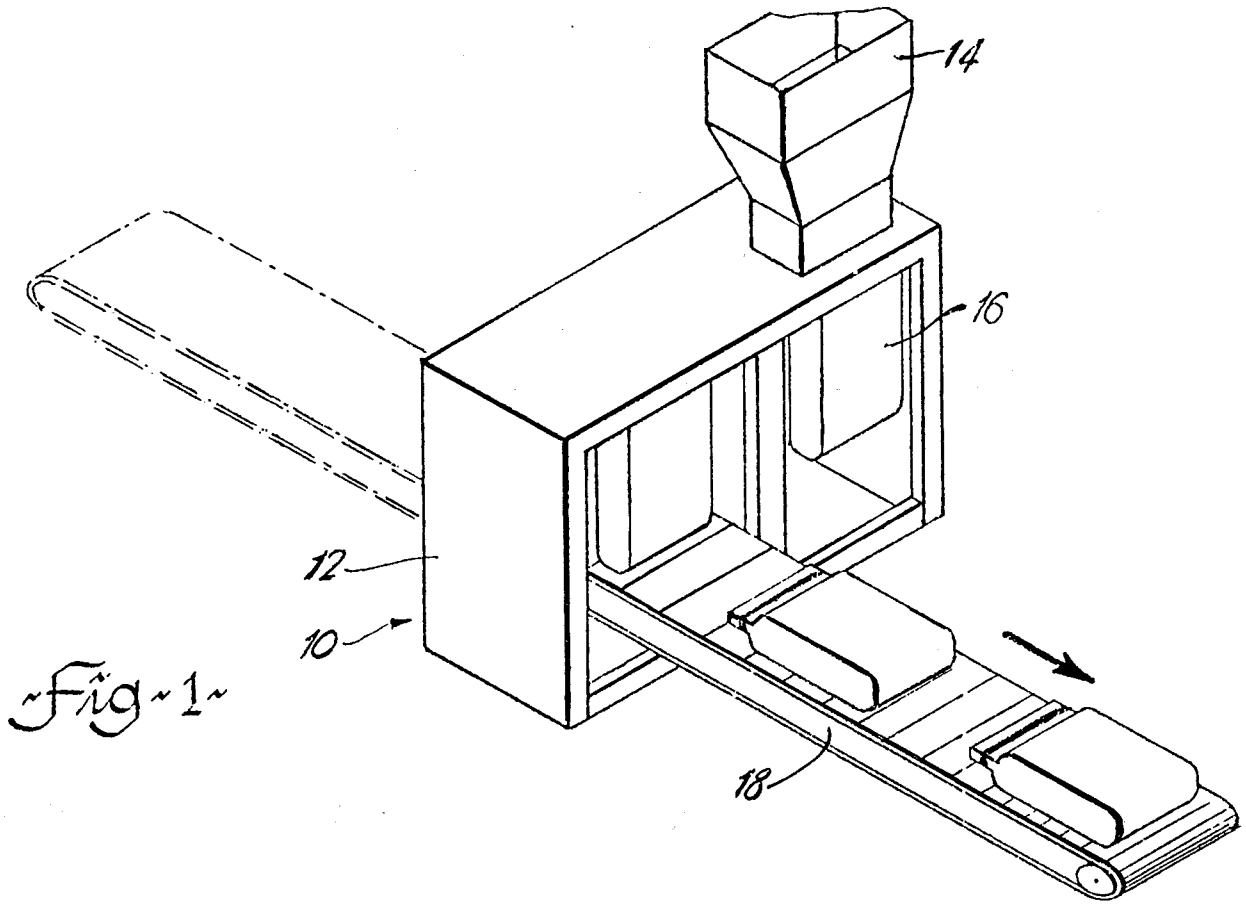
FIG. 1 is a perspective view of the first embodiment of the apparatus of the present invention.

FIG. 1 broadly illustrates the bag loading and sealing apparatus of the present invention as it might be found in an industrial environment. The apparatus 10 thus includes a general framework or housing 12 provided with a hopper 14 which receives the commodity to be loaded, the commodity arriving at the hopper as a predetermined weight, volume or quantity, or being appropriately measured right at the hopper. The manner in which the correct amount of commodity to be loaded is determined does not form a part of this invention. Neither does the manner in which the commodity is fed to the hopper 14, although it is expected that an appropriate conveyer could be used. On the side of the framework carrying the hopper, means are provided for holding a plurality of empty bags (see FIG. 5) so that each bag may, in turn, be filled with the commodity from the hopper (see filled bag 16) (FIG. 1). Also mounted in the framework are means for moving a filled bag laterally away from the hopper area and, if required, for simultaneously sealing the bag (see FIG. 6). The laterally shifted bag is then released to fall on a take-away conveyor 18 positioned so as to extend through the framework 12 and to receive the filled, and possibly sealed, bags. FIG. 1, by the way, shows the bag tops as being heat sealed as by a bar sealer.

Figure 5:
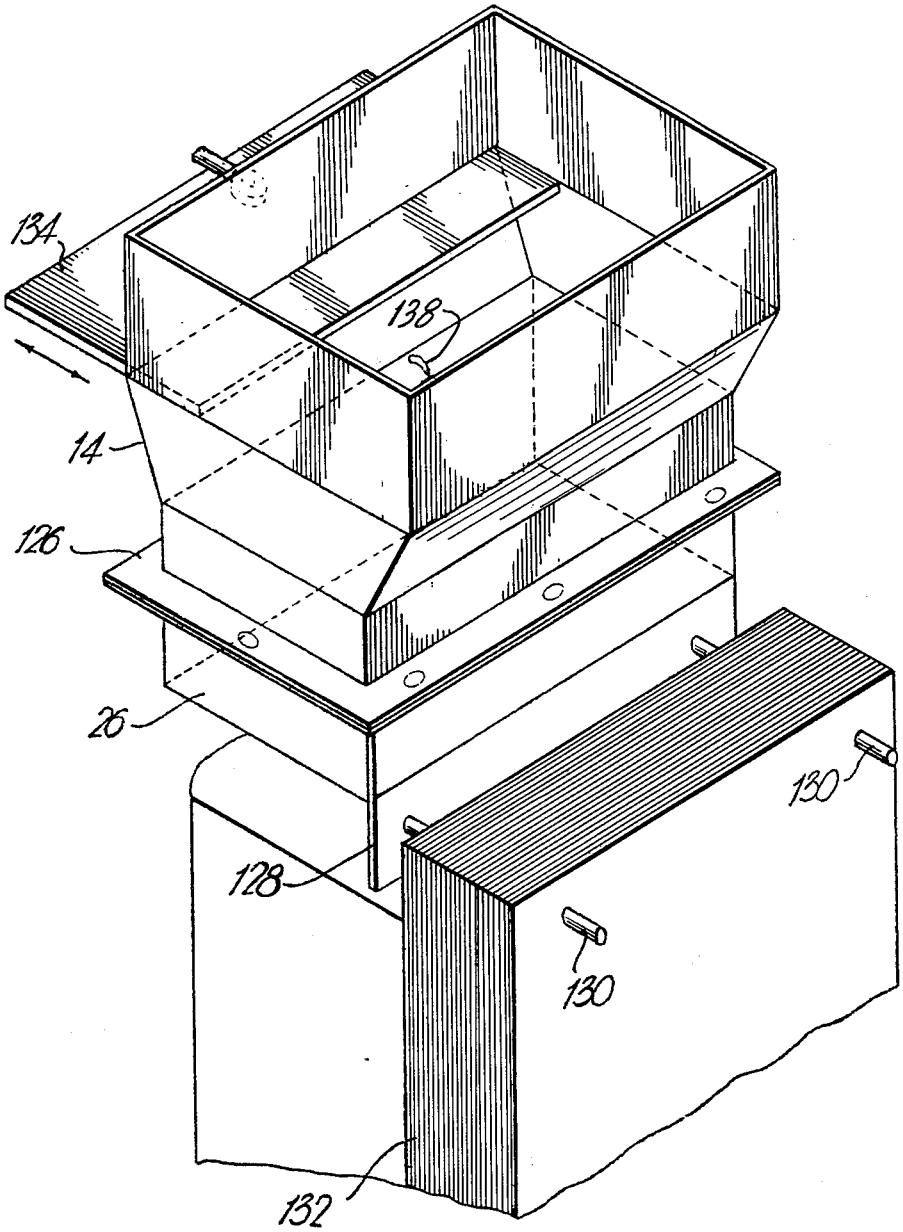
FIG. 5 is a perspective view of the hopper assembly used in the first embodiment.
Figure 6:
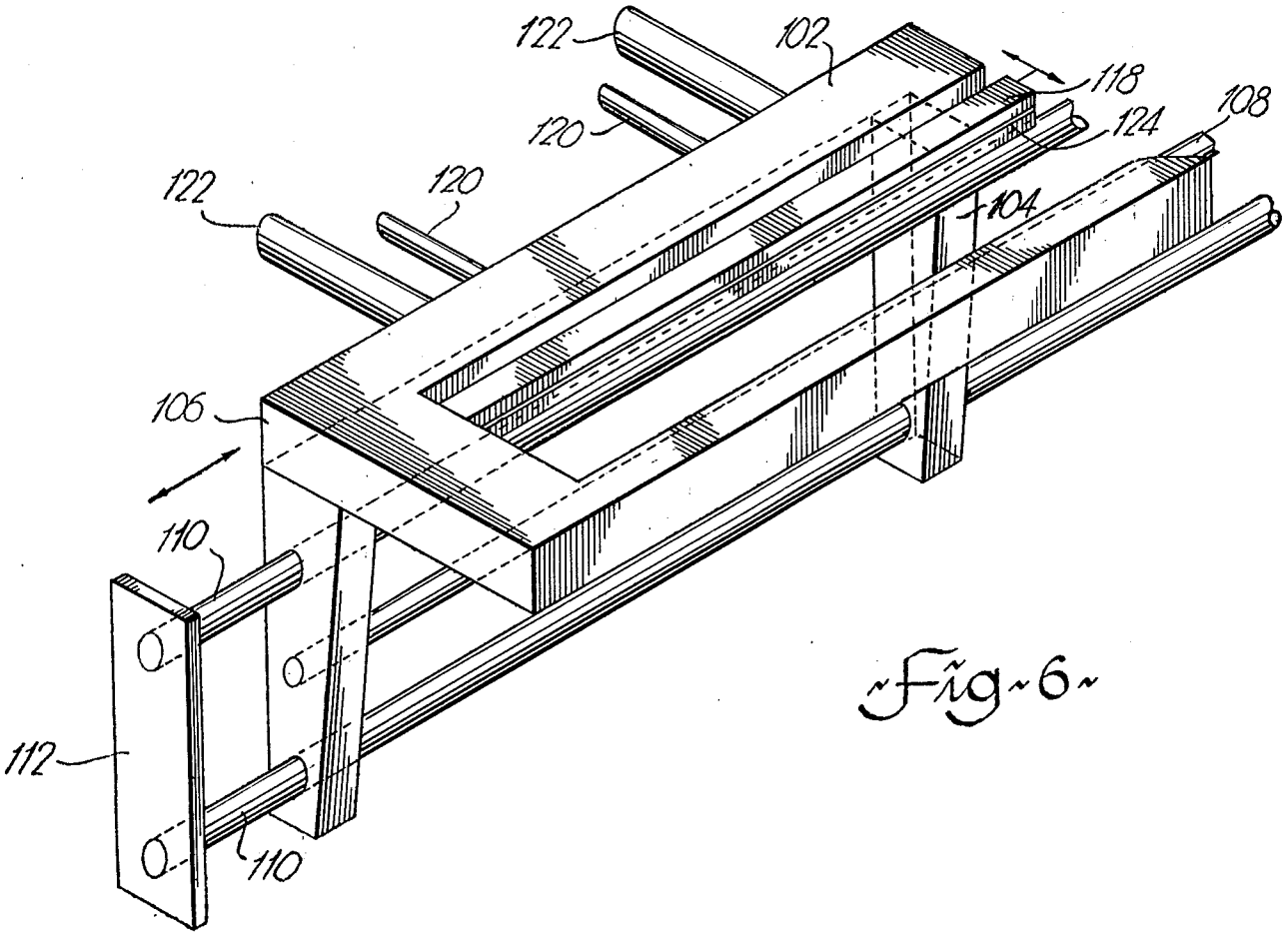
FIG. 6 is an enlarged view of the bag clamping and carrying mechanism.
Figure 7:
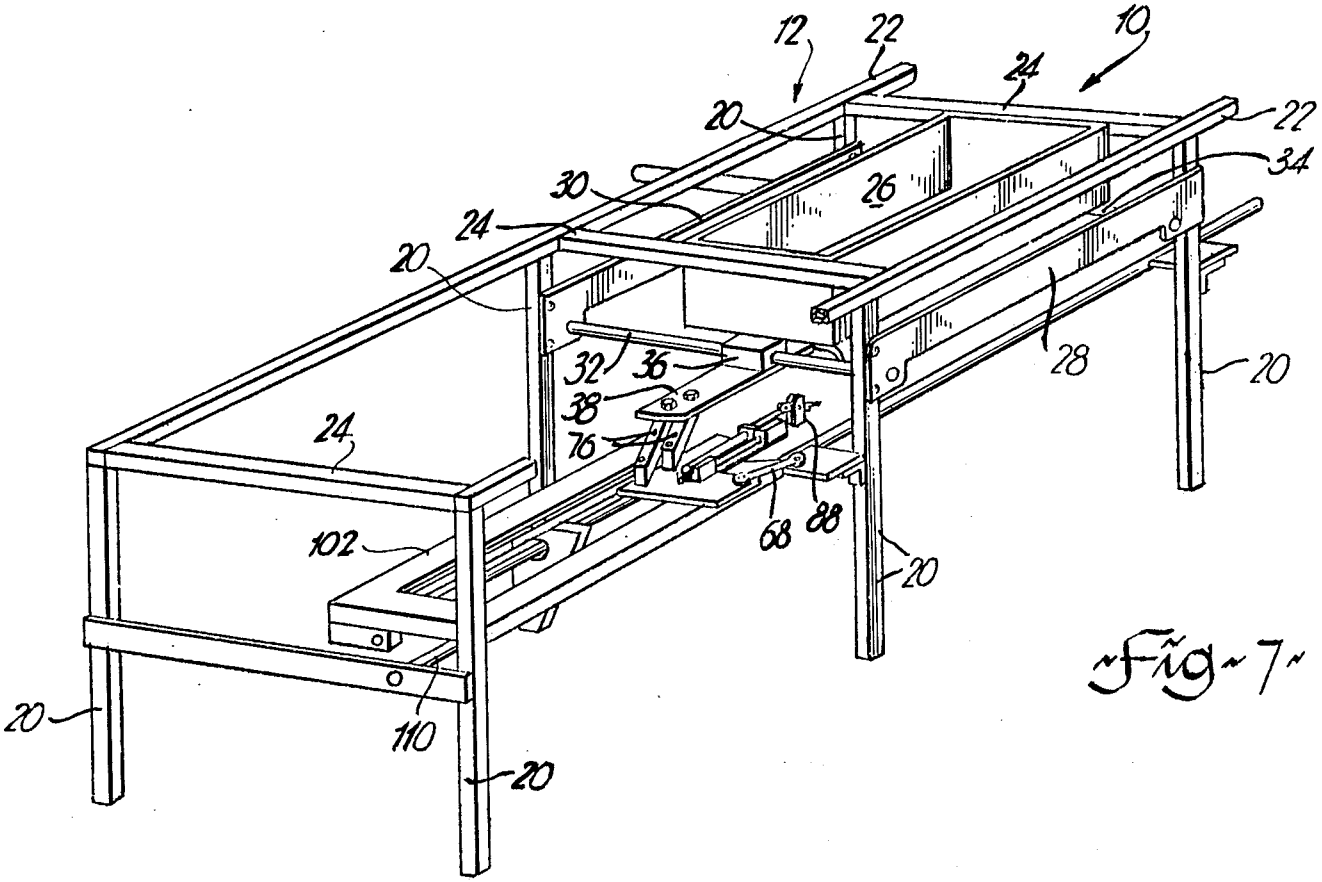
FIG. 7 is a view similar to that of FIG. 2 but showing the internal structure of a second embodiment.

FIGS. 2 to 7 illustrate the internal structure of the present invention in greater detail than does FIG. 1. As seen in FIG. 7, the framework 12 (applicable to both embodiments) includes a number of upright members 20, a number of longitudinal members 22, and a number of transverse members 24. The lowermost section 26 of the hopper 14 is shown as being mounted between a pair of the transverse members 24. Opposite the front and rear faces of hopper section 26 are a pair of cross-members 28,30 spanning the distance between the respective pairs of uprights 20 associated with the transverse members carrying hopper section 26.

Figure 2:
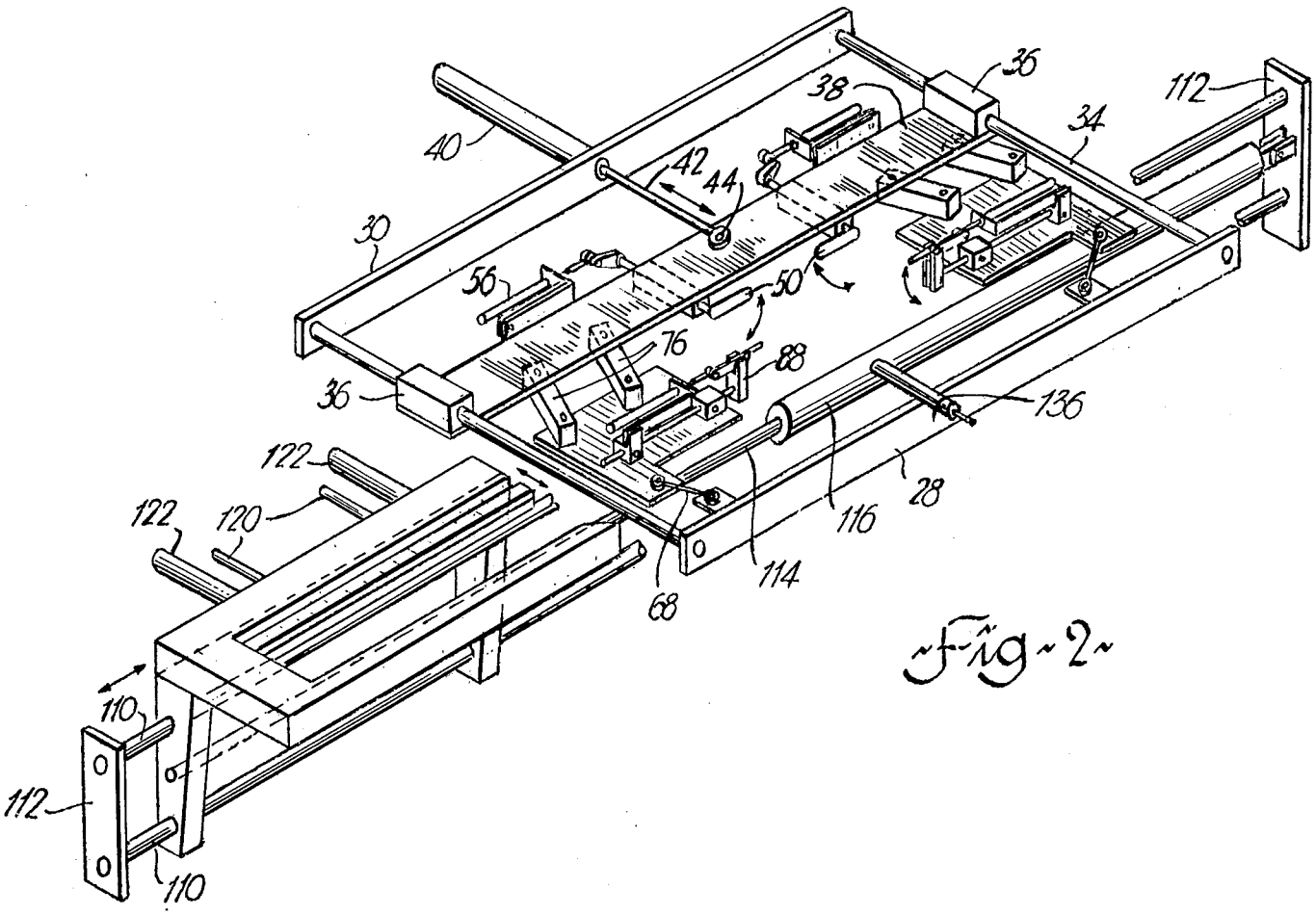
FIG. 2 is a view similar to that of FIG. 1 but showing the internal structure of the first embodiment of the present invention.

Extending between the members 28 and 30 is a pair of guide rods 32,34 each rod being parallel to the transverse members 24 and being anchored securely to the members 28,30. Each rod carries a bearing block 36 reciprocally slidable thereon, the bearing blocks being elongated in the direction of the rods and being generally rectangular in cross-section. Rigidly affixed adjacent each end to a respective bearing block is a closure member or carrier plate 38, the plate spanning the distance between the blocks 36. The elevation of plate 38 within the framework is such that its upper surface makes sliding contact with the bottom edge of hopper section 26. Reciprocal movement of plate 38 is provided by a hydraulic or pneumatic cylinder 40 centrally affixed to member 30, the rod 42 of cylinder 40 extending through member 30 for attachment to plate 38 as at 44. If desired, carrier plate 38 may be of sufficient width to completely block the lower opening of hopper section 26 whereby the measured commodity or product may rest thereon prior to loading. In such an instance, the connection 44 between rod 42 and plate 38 would be on the underside of plate 38 rather than on the top as shown in FIG. 2. This latter configuration is more relevant to the embodiment shown in FIG. 7.

Affixed to the underside of carrier plate 38 is a pair of spaced apart bearing blocks 46, each carrying therein a rotatable shaft 48. At one end of each shaft 48 is a generally rectangular finger 50 and at the other end each shaft mounts a link 52. Each link is, in turn, pivotally connected to the rod 54 of a cylinder 56. Each cylinder is mounted to the short leg of an L-shaped bracket 58, the other leg of which is pivotally connected to a bracket 60, as at 62, the brackets 60 being affixed to the rear edge of plate 38. This bag opening assembly, the operation of which will be described hereinafter, is shown in detail in FIG. 4.

Figure 3:
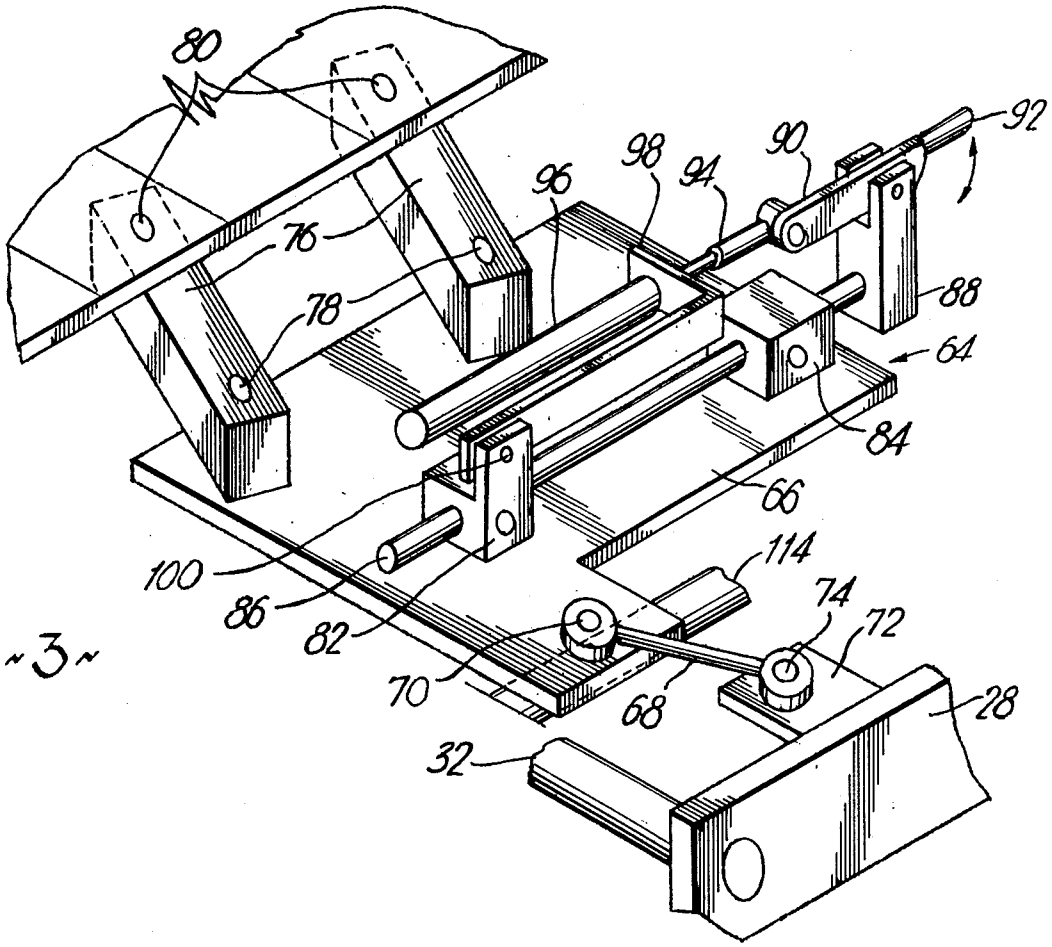
FIG. 3 is an enlarged view of the bag clamping mechanism.
Figure 4:
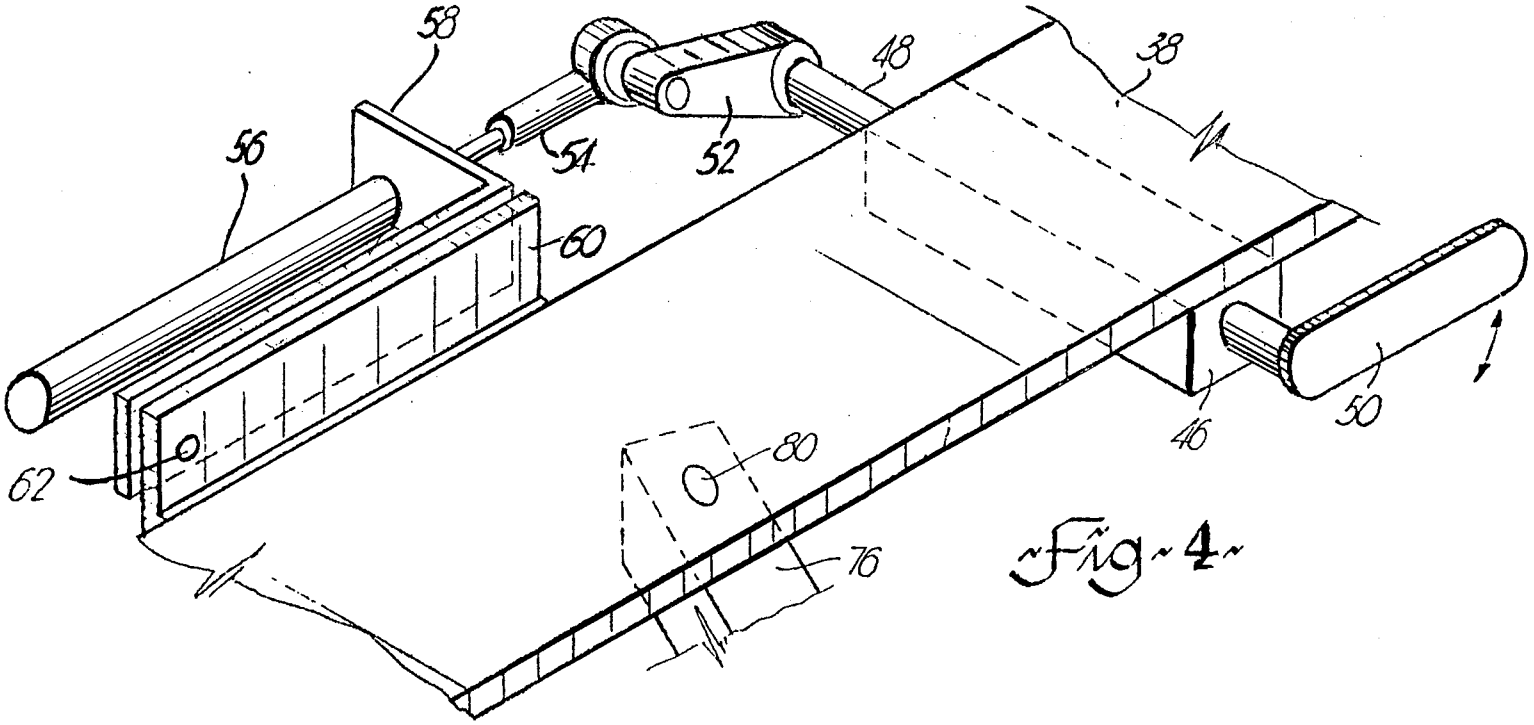
FIG. 4 is an enlarged view of the bag opening finger mechanism.

FIG. 3 illustrates a bag gripping or clamping mechanism 64 which includes a generally horizontal carrier plate 66 which is located by a link 68 pivotally connected to the plate 66 as at 70 and to a bracket 72 as at 74. Bracket 72 may be affixed to cross-member 28 as illustrated in FIG. 2 for the first embodiment, or to an upright 20 as illustrated in FIG. 7 for the second embodiment. As seen in FIG. 2 there are two such mechanisms 64, one at each end of carrier plate 38. Carrier plate 66 is further located by a pair of parallel links 76 each of which is pivotally connected to the carrier plate 66 as at 78 and to the carrier plate 38 as at 80. Links 76 along with the carrier plates 38 and 66 form a parallelogram.

Mounted to each carrier plate 66 are mounting blocks 82 and 84, these blocks carrying a support rod 86 extending parallel to the carrier plate 38. At the inboard end, each rod 86 mounts a vertical clamping block 88 which trunnionly mounts a bell-crank 90, one end of which carries a short rod 92 of small diameter. The opposite end of bell-crank 90 is pivotally connected to the rod 94 of a cylinder 96 which, in turn, is affixed to an L-shaped bracket 98 in the same manner as cylinder 56. Bracket 98 is pivotally connected to the mounting block 82 as at 100.

Turning now to FIGS. 2 and 6, the bag clamping and carrying mechanism will be desribed. As seen in FIG. 2, this mechanism is laterally offset from the previously described structure and would usually be situated above the conveyor 18 of FIG. 1. This mechanism includes a generally U-shaped horizontal member 102 provided with two downwardly projecting legs 104,106 one leg being mounted at one end of one of the arms of the member, the other leg being mounted at the other end of the same arm. The other arm has a bevelled portion 108 at the entrance to the member. A pair of vertically spaced apart guide rods 110 pass through the legs 104,106 and extend the full length of the apparatus to be affixed to upright members 112 mounted in the framework 12. Affixed to the leg 106 and passing through the leg 104 is the rod 114 of a cylinder 116 which, in turn, is pivotally mounted to the upright member 112 at the opposite end of the framework to leg 106. Guide rods 110 and cylinder 114 are positioned behind the hopper section 26 to avoid interference with an opened bag.

Reciprocably mounted within the opening of member 102 is a clamping bar 118, supported by a pair of guide rods 120 extending through the adjacent member arm and driven by a pair of cylinders 122. Clamping bar 118 may carry in its inward face a heating element 124 of a conventional bar sealer.

FIG. 5 illustrates a hopper and bag holding assembly which is especially adapted for use in the first embodiment of the present invention. In this instance, reference number 126 denotes the top surface of the framework 12 and it is seen that lower hopper section 26 is positioned therebelow. A wicket assembly constituting a mounting plate 128 and a pair of wicket rods 130 is mounted to top surface 126 in front of the apparatus (deleted from FIG. 1 for clarity). The wicket rods 130 support a plurality of wicket bags 132 in their closed state, wicket bags being of the type that have an extension of one side projecting above the bag opening with the extension having a pair of holes for receiving the wicket rods 130. The bag opening is located just below the lower edges of the mounting plate 128.

As seen in FIG. 5 the hopper 14 extends above surface 126 and is provided with a reciprocable wall 134 which slides in suitable guides (not shown) so that it can fully close or fully open the hopper 14, drive for the wall 134 being provided by a cylinder 136 suitably mounted to the framework. Also mounted within the hopper 14 is a plurality, such as three, of nozzles 138 which point towards the opening of the next bag to be filled. With this configuration, the carrier plate 38 would only partially cover the opening of lower hopper section 126 so that there is a clear path between the nozzles and the bag opening.

Turning now to the second embodiment, as shown in FIG. 7, the movable wall 134 is omitted and carrier plate 38 constitutes the only closure for the hopper. Nozzles 138 in this instance could then be positioned on the underside of carrier plate 38 although they would still be directed towards the bag opening. The central zone of the plate 38, with nozzles attached could then be similar in configuration to the bottom plate or wall illustrated in Canadian Patent No. 1,008,040 issued April 5, 1977 and assigned to the assignee of the present invention. Also, as an alternative, the nozzles could be positioned on the outside wall of lower hopper section 26 if there is sufficient clearance provided adjacent the leading edge of plate 38, when in the closed position, to permit an air blast to reach the bag opening. The clearance could be very slight whereby there would be no deleterious effect on the load-carrying ability of the plate 38.

Another alternative construction is shown in FIG. 7 whereby the rods 32 are positioned inboard of the pivot points for the links 76 rather than outboard thereof as shown in FIG. 2. The positioning of the rods is not critical and the actual location would be determined on the basis of the dimensional limitations of the apparatus as required.

The operation of the present invention will now described in relation to the first embodiment. It is initially assumed that carrier plate 38 is positioned below hopper section 26 and that movable wall 134 closes the upper hopper section. It is further initially assumed that the correct amount of commodity to be loaded has been fed to the upper hopper section to rest on wall 134 and that a supply of wicket bags is positioned on the wicket rods 130. In this configuration, the sealing and carrying mechanism of FIG. 6 is positioned above conveyor 18.

Upon initiation of the apparatus cycle, air is caused to jet from the nozzles 138, the jet being directed towards the opening in the first unused wicketted bag thereby causing the bag to puff open. Cylinders 56 are then actuated in order to cause rotation of fingers 50 from their horizontal position to their vertical position extending downwardly into the bag opening. Essentially simultaneously cylinders 40 and 136 are actuated to retract the carrier plate 38 and wall 134 respectively whereby the commodity will descend through the hopper and into the opened bag. When the plate 38 has reached the end of its retractive motion the bag opening will be large and generally square as formed by the fingers 50.

During the retractive motion of plate 38 forces are applied to the two carrier plates 66 via the parallel links 76 tending to move the plates 66 in conjunction with the plate 38. Such motion, however, is constrained by the links 68 and hence the plates 66 actually follow an arcuate horizontal path from their rest position well outboard of hopper section 26 to a new position adjacent the hopper section 26. Links 76 and 68 along with the clamping mechanism mounted on plates 66 are dimensioned so that, in this new position, the mid-point of the adjacent end edges of the opened and loaded bag are very close to the adjacent side of the corresponding clamping block 88. when plates 66 reach this new position, cylinders 96 are actuated whereby rods 92 are caused to pivot into the bag opening and to clamp the adjacent end edge of the bag against the corresponding clamping block 88.

At this point in the cycle, fingers 50 are retracted from the interior of the bag opening and plate 38 as well as wall 134 return to their positions blocking their respective hopper sections. This movement of plate 38 causes retractive movement of plates 66 through the parallel links 76 as constrained by links 68 whereby plates 66 return to their rest positions. However, the rods 92 still clamp the bag sides and this returning movement of the plates 66 thereby causes the bag opening to close to a line between the opposed rods 92. The width of the bag opening now corresponds only to the diameter of the rods 92 and forms a slit with the opposed faces of the bag opening in close juxtaposition.

With the bag opening drawn taught by the rods 92, the clamping mechanism of FIG. 6 is then actuated via cylinder 116 whereby the U-shaped member 102 moves laterally and the arms thereof are positioned so that the bag opening is located therebetween. The bevelled edge 108 helps to guide the member 102 with respect to the bag opening and will prevent any jamming of the mechanism should the bag be positioned to one side or the other of its usual line. Once the member 102 is in position the clamping bar 118 is brought into registry with the bag side in order to clamp the opposed bag faces together against the arm having the bevelled entrance portion 108. The clamping action will take place below the lowermost end of the rods 92 to avoid any interference therewith and to permit the rods to be withdrawn following the clamping action.

The clamped bag is then withdrawn laterally by the mechanism as driven by cylinder 116 and this movement tears the bag from the wicket rods 130. During the lateral movement, the bag may be heat sealed via the bar sealer 124. Once the clamping and sealing mechanism has returned to its rest location, the clamping bar 118 retracts to release the bag to fall to the take-off conveyor 18.

The operation of the FIG. 7 embodiment is identical to that described hereinabove with the exception that the commodity to be loaded rests directly on the carrier plate 38 drops into the opened bag upon retractive movement of the plate 38. The location of the parallel links 76 outboard of the bearing blocks 36 has no bearing on the operation of the invention.

It is thus seen that the present invention provides a compact and efficient loader for wicketted bags, the loader being fully automatic in operation. Proper quantities of a commodity may be loaded in a wicket bag and the bag sealed in a continuous operation which permits a loading operation to be taking place simultaneously with a sealing operation on a previously loaded bag. The invention could be used as well to merely transport a loaded bag laterally to subsequent closure equipment if heat sealing as illustrated is not desired or required.

Needless to say suitable microswitches, relays and timers would be used in the pneumatic and electric circuits as required to control or adjust the operating cycle. Such circuitry can be provided by a skilled practitioner and does not form a part of the present invention. Undoubtedly, variations in the present invention may occur to a skilled practitioner and hence the scope of protection afforded the invention should be determined from the appended claims.

The embodiments of the invention in which an exclusive property or privilege is claimed are defined as follows:

1. Apparatus for loading a bag with a commodity comprising:

(a) a framework;

(b) a carrier member retractably mounted in said framework;

(c) means for arranging at least one empty bag in said framework, said bag having an open end adjacent said carrier member;

(d) means for opening said bag and retracting said carrier member, said member serving to hold said bag open;

(e) means for gripping opposed top edge portions of said opened bag, said gripping means including, for each of said opposed edge portions of said opened bag, a rod rotatable into said bag opening and a clamping block to which said rod is pivotally mounted, said rod, upon rotation into said bag clamping the adjacent bag edge portion against said clamping block;

(f) means for moving said gripping means apart thereby bringing opposed faces of said bag into close juxtaposition; and (g) means for clamping said opposed faces together and removing the clamped bag from said framework.

2. The apparatus of claim 1, including means integral with said clamping means for sealing said opposed faces together.

3. The apparatus of claim 1, wherein said opening and retracting means includes nozzle means adapted to provide a jet of air against the opening of the closed bag to initially open the bag, a pair of rotatable fingers positioned below said carrier member for rotation into said initially opened bag and drive means for retracting said carrier member whereby said fingers will pull the bag opening to its fully open configuration.

4. The apparatus of claim 1, wherein said moving means includes, for each end portion of said opened bag, a carrier plate mounting said clamping block and a drive cylinder for said rod, a pair of parallel links pivotally connecting said plate to said carrier member, and a constraining link connecting said plate to a fixed member, movement of said carrier member causing conjoint movement of said plate toward or away from said end portions of the bag, the movement of said plate being constrained by said constraining link to an arcuate path.

5. The apparatus of claim 4, wherein said clamping means includes a generally U-shaped horizontal member having a movable clamping bar in the central portion thereof for movement toward and away from one arm of said horizontal member, drive means for moving said horizontal member to a position wherein the bag faces are located between said clamping bar and said one arm, and drive means for moving said clamping bar towards said one arm to clamp the opposed bag faces therebetween.

6. The apparatus of claim 5, and including heat sealing means in said clamping bar.

7. Apparatus for loading a bag with a commodity via a hopper having a retractable bottom closure member and closing the bag, comprising:

(a) a framework mounting said hopper therein, said hopper opening downwardly;

(b) a pair of wicket rods adjacent said hopper for receiving a plurality of upwardly opening wicket bags face to face;

(c) drive means for retracting said closure member to permit the commodity to pass downwardly from the hopper;

(d) rotatable finger means on said closure member for engaging a free face of a bag and pulling the bag open as the closure member retracts to thereby form the bag opening to a generally square configuration with opposed end portions;

(e) for each end portion of said bag a carrier plate mounting bag gripping means and movable in relation to said closure member whereby said gripping means is positioned to grip the adjacent end portion of the opened bag when said closure member is fully retracted;

(f) said carrier plates and gripping means being movable apart as said closure member returns to its position below the hopper whereby opposed faces of the bag are drawn into close juxtaposition;

(g) a generally U-shaped clamping member having a clamping bar therein movable toward and away from one arm of said clamping member, the opposed faces of said bag being receivable between said bar and said one arm for clamping thereby; and (h) drive means for moving said clamping member toward said bag for clamping thereof and away from said hopper with said bag clamped therein.

8. The apparatus of claim 7, and including a plurality of nozzles directed toward the upper area of an unopened bag for directing a jet of air at said upper zone to initially open the bag for entry of said finger means thereinto.

9. The apparatus of claim 7, and including, for each said carrier plate, a pair of parallel links pivotally connected at one end to the carrier plate and at the other end to said closure member and a single link connecting the carrier plate, at a side opposite said parallel links, to the framework, said single link constraining the movement of said carrier plate as produced by said closure member via said parallel links.

10. The apparatus of claim 9 wherein each said gripping means includes a clamping block connected to said carrier plate, a rod pivotally connected to said clamping block and drive means for rotating said rod towards or away from said clamping block.

11. The apparatus of claim 7, and including a heat sealing element mounted in said clamping bar.

12. The apparatus of claim 7, and including a retractable wall member in said hopper adapted for simultaneous movement with said closure member.

13. Apparatus for loading a bag with a commodity via a hopper having a retractable closure member and closing the bag comprising a framework mounting said hopper, a pair of guide rods mounted in said framework adjacent each end of said hopper, a bearing block slidably received on each guide rod and connected to a corresponding end of said closure member, a plurality of nozzles mounted to said hopper, a pair of wicket rods mounted adjacent said hopper, a pair of rotatable fingers mounted to the underside of said closure member, a carrier plate adjacent each end of said hopper, each plate being connected to an adjacent end of said closure member via a pair of pivotally attached parallel links, and being connected to said framework by a single pivotally connected link, a clamping block attached to each plate, a rod pivotally connected to each clamping block, drive means on said plate and connected to said rod, a generally U-shaped clamping member, a clamping bar positioned between the arms of said clamping member, and drive means mounted in said framework connected to said clamping member for movement thereof toward and away from said hopper.

14. A method for loading a bag with a commodity from a hopper mounted in a framework having a movable carrier member comprising the steps of:

(a) in closely timed relationship retracting said carrier member, opening a bag below said hopper, and gripping opposed top edges of said bag at the opening thereof by rotating a clamping rod into said opened bag at the mid-point of each opposed top edge portion and clamping the adjacent edge portion between the rod and an adjacent clamping block;

(b) filling the bag by permitting the commodity to descend from said hopper into the opened bag;

(c) drawing said opening to an essentially closed condition by moving said opposed top edges away from each other, thereby creating a pair of opposed and closely adjacent bag faces and (d) clamping said faces together over substantially the entire length thereof to hold said bag firmly, and laterally withdrawing the clamped bag from below said hopper.

15. The method of claim 14, wherein said bag opening step includes the steps of directing at least one jet of air against an upper zone of the bag to initially puff said bag partially open, and engaging a pair of rotatable fingers mounted to said carrier member with said partially opened bag to draw the bag fully open during retraction of said carrier member.

16. The method of claim 14, and including the step of heat sealing the opposed faces together during said clamping and withdrawing steps.

17. A method for loading a bag with a commodity and for closing the bag comprising:

(a) positioning an empty bag adjacent a hopper having a retractable bottom member;

(b) opening the bag as said bottom member retracts, whereby the opening of said bag encompasses the bottom opening of said hopper as the bottom member reaches the end of its travel;

(c) essentially simultaneously gripping opposed top edge portions of said bag opening by rotating a clamping rod into said opened bag at the mid-point of each opposed top edge portion and clamping the adjacent top edge portion between the rod and an adjacent clamping block;

(d) filling the bag by permitting the commodity to descend from the hopper into the opened bag;

(e) drawing said top edge portions apart as said carrier member returns to its position underlying said hopper opening to form said bag opening into an elongated slit between two opposed bag faces in close juxtaposition;

(f) clamping said opposed bag faces together over the length of said faces;

(g) releasing said top edge portions and (h) laterally withdrawing the closed bag from below the hopper.

18. The method of claim 17 wherein said bag opening step includes the steps of directing at least one jet of air against an upper zone of the bag to initially puff said bag partially open, and engaging a pair of rotatable fingers mounted to said retractable member with said partially opened bag to draw the bag fully open during retraction of said retractable member.

19. The method of claim 14, and including the step of heat sealing the opposed faces together during said clamping and withdrawing steps.

* * * * *